US005174091A

United States Patent [19]

Stokx

[11] Patent Number: 5,174,091

[45] Date of Patent: Dec. 29, 1992

[54] GRILLE CLIP

[75] Inventor: Gary Stokx, Whitby, Canada

[73] Assignee: Mason Windows Limited, Ontario, Canada

[21] Appl. No.: 804,699

[22] Filed: Dec. 11, 1991

[51] Int. Cl.[5] ..... E05D 5/12

[52] U.S. Cl. ..... 52/507; 52/698; 52/830; 52/456; 292/190

[58] Field of Search ..... 52/507, 830, 698, 456, 52/665, 663; 292/80, 87, 190

[56] References Cited

U.S. PATENT DOCUMENTS

| | | | |
|---|---|---|---|
| 508,999 | 11/1893 | Tobey . | |
| 611,295 | 9/1898 | Towne | 292/80 |
| 815,638 | 3/1906 | Sandberg . | |
| 3,221,462 | 12/1965 | Pomeroy . | |
| 3,248,838 | 5/1966 | Stark | 52/698 |
| 3,254,465 | 6/1966 | Brengman et al. | 52/455 |
| 3,276,167 | 10/1966 | Bus et al. . | |
| 3,372,522 | 3/1968 | Engstrom | 52/507 |
| 3,385,157 | 5/1968 | Rapata . | |
| 3,438,112 | 4/1969 | Labruyere . | |
| 3,680,177 | 8/1972 | Ginsberg . | |
| 3,811,725 | 5/1974 | Bauer . | |
| 4,400,923 | 8/1983 | Giguere . | |

FOREIGN PATENT DOCUMENTS

| | | |
|---|---|---|
| 1160103 | 1/1984 | Canada . |
| 2007161 | 11/1971 | Fed. Rep. of Germany . |
| 1315418 | 12/1962 | France . |

*Primary Examiner*—David A. Scherbel
*Assistant Examiner*—Wynn E. Wood
*Attorney, Agent, or Firm*—Staas & Halsey

[57] ABSTRACT

A clip is provided to be attached to a grille member, such as a decorative grille for a window, which is used to detachably secure the grille member to a frame or sash. The clip is secured in a cavity found at the end of the grille member by teeth which extend from the stem of the clip. The clip has a base which is connected to the stem of the clip at an oblique angle. The clip has a head portion which comprises two overlapping arcuate members which, when the grille member is in place, are flexibly biased against the frame or sash in order to detachably secure the grille member.

8 Claims, 2 Drawing Sheets

GRILLE CLIP

FIELD OF THE INVENTION

The present invention relates in general to fasteners, and more particularly to a novel design of a clip to detachably secure a decorative grille in a window frame or sash.

BACKGROUND OF THE INVENTION

Prior art devices are known for detachably securing decorative grilles (or "muntin structures", as they are sometimes called) to window frames.

For example, U.S. Pat. No. 3,221,462 (Pomeroy), discloses slidable fasteners mounted in passageways cut into the opposite ends of the decorative grille. The slidable fasteners may be retracted into the passageways or extended such that a toe portion of the fastener is extended outwardly into an opening provided in the window casing. When the fasteners are extended the grille is secured in place, when they are retracted the grille may be removed from the window frame.

U.S. Pat. No. 3,254,465 (Brengman et al) teaches a spring mounting clip made of resilient material. The clip has a base section that is generally flat with elongated mounting protrusions to engage the sides of a slot in the end of the grille. There is an arcuate terminal section with the convex surface facing away from the base section so as to contact the window frame when the grille is put into place. The arcuate section is connected to the base section by an intermediate section which permits the arcuate section to resiliently flex toward the base when the grille is inserted into a window.

Canadian Patent 1,160,103 (Giguere) discloses a one-piece plastic molded catch member for mounting a decorative grille. In order to receive the grille, the window must have a sash with at least two opposite sides having the base section so as to contact the window frame when the grille is put into place. The arcuate section is connected to the base section by an intermediate section which permits the arcuate section to resiliently flex toward the base when the grille is inserted into a window.

Canadian Patent 1,160,103 (Giguere) discloses a one-piece plastic molded catch member for mounting a decorative grille. In order to receive the grille, the window must have a sash with at least two opposite sides having inwardly facing shallow grooves. The catch member is retained in the end of the grille by a stem having longitudinally extending radial ribs. Each radial rib is of constant triangular cross-section. The clip has a convex head portion having an arcuate arm which overlies the base of the clip and when is resiliently movable towards the bass. When the grille is placed in the window frame, the convex head portions of the clip at each end of the grille are retained in the shallow grooves in the sash.

Accordingly, the prior art discloses the general concept of detachably securing a grille in a window frame using clips secured at the ends of the grille. The prior art teaches that such clips may have resilient arcuate members which frictionally engage the window frame and which may be secured to the grille by a stem having longitudinally extending ribs or elongated protrusions.

SUMMARY OF THE INVENTION

According to the present invention, a clip is provided which is attached to a grille member, such as decorative grille for a window, in order to detachably secure one end of the grille member to a frame or sash. The grille member is made from wood, styrene, PVC, or similar material. Such a clip may be used at each end of the grille member, in order to detachably secure the grille member to a frame or sash. The clip has three components: a head, a base and a stem. The base of clip is flat and rectangular. The stem and the head are attached to opposite sides of the base. A plurality of teeth extend from the stem. The stem fits into a cavity in the end of the grille member such that the teeth engage the side walls of the cavity, thereby securing the clip to the grille member. The teeth provide a mechanism for permanently fastening the clip to the grille member without the need for a specially designed cavity, stem or fastening means. The stem of the clip can be manually inserted into the suitably sized cavity by hand and the teeth automatically act to retain the clip in place.

The stem is connected to the base at an oblique angle. Construction of the stem at an oblique angle to the base is particularly advantageous in situations where the ends of the decorative window grille are cut at a corresponding angle. Such a grille may be installed so that the angle of the cut at the ends of the grille members is away from the interior of the window. Such an angled cut serves to conceal the clip attached to the end of the grille when viewed from the inside of the window. The oblique angle of the stem of the clip permits the cavity into which the stem is received to be parallel to the longitudinal axis of the grille member while the base of the clip lies flush with the angled end of the grille. Permitting the cavity in the grille member to lie in the plane parallel to the longitudinal axis of the grille member minimizes weakening of the member due to the presence of the cavity.

The head of the clip comprises two flexible arcuate members which project from opposite edges of the base toward each other so as to overlap. The arcuate members are flexibly biased against the frame or sash in order that the grille member may be detachably secured to the frame or sash by frictional force of the head against the frame or sash. The first of such arcuate members extends from one edge of the base almost to the opposite edge of the base. The second arcuate member lies inside the first and is connected to the base at an opposite edge to that of the first member. The second member is shorter than the first and does not extend past the mid-point of the base. The second arcuate member reinforces the first arcuate member so that the first arcuate member may be made sufficiently thin to be flexible. The first arcuate member is sufficiently long to ensure that the distal end of the member does not catch on the frame, or sash in response to the grille member being removed from the frame or sash.

In general, according to a first aspect of the present invention, there is provided a clip for detachably securing a grille member to a frame or sash, said grille member having a cavity therein, comprising:

(a) a rectangular cross-section stem adapted to be inserted in said cavity, said stem having a plurality of teeth extending therefrom for securing said stem within said cavity;

(b) a flat, rectangular base connected to the stem at an oblique angle thereto;

(c) two flexible, resilient arcuate member projecting from opposite edges of the base toward each other and away from the stem, the arcuate members being adapted to frictionally engage said frame or sash and thereby flexibly secure said grille member to the frame or sash.

BRIEF DESCRIPTION OF THE DRAWINGS

Embodiments of the invention will be described hereinafter with reference to the following drawings, in which.

DETAILED DESCRIPTION OF THE INVENTION

Figure 1:
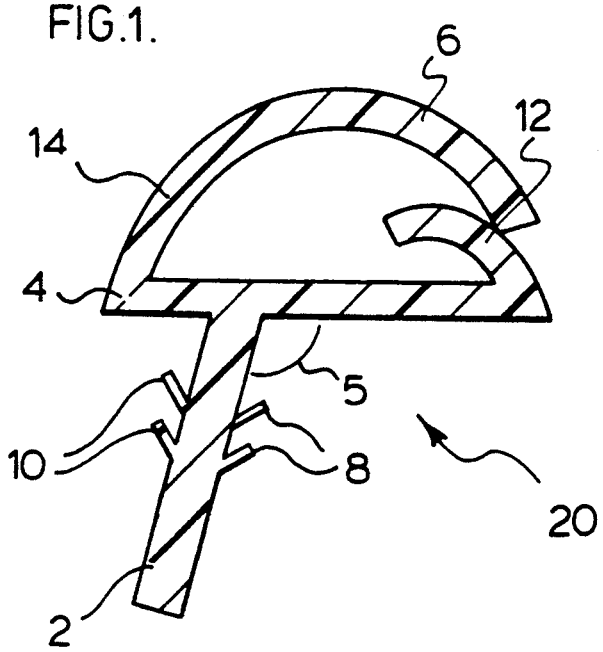
FIG. 1 is a cross-section view of the clip according to a preferred embodiment.

Turning to FIG. 1, a preferred embodiment of the grille clip of the invention is shown. A rectangular base 4 is connected on opposite sides to the stem 2 and the head 6. The stem 2 is connected to the base 4 at oblique angle 5. The head 6 is made up of two arcuate members 12 and 14. Arcuate members 12 and 14 are of a thickness such that they are resiliently flexible, the flexibility of member 12 may be less than that of arcuate member 14. Arcuate member 14 extends so as to overlap arcuate member 12, such that the member 12 supports and provides reinforcement for arcuate member 14.

Figure 5:
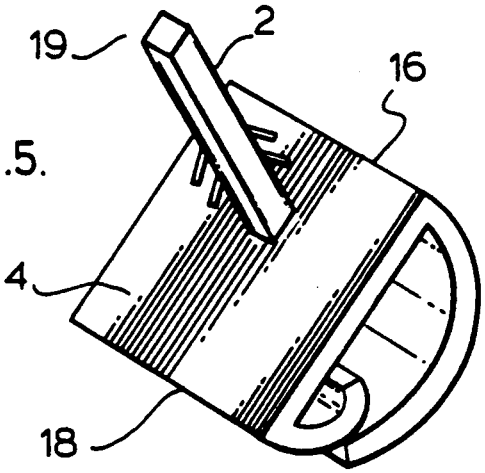
FIG. 5 is a perspective view of a clip showing the stem end of the clip.

As may be seen from FIG. 5, the stem 2 in this preferred embodiment is connected to the base 4 at a point which is closer to edge 16 of base 4 than to edge 18 of the base 4.

Two sets of teeth 8 and 10 extend from the stem 2. The teeth are angled towards the base 4. As FIGS. 1 and 5 illustrate, the teeth are located on opposite sides of the stem 2 and are closer tot he base 4 than to the distal end of the stem 19. The teeth making up each of the sets 8 and 10 are located on behind the other on the longitudinal axis of stem 2.

Figure 2:
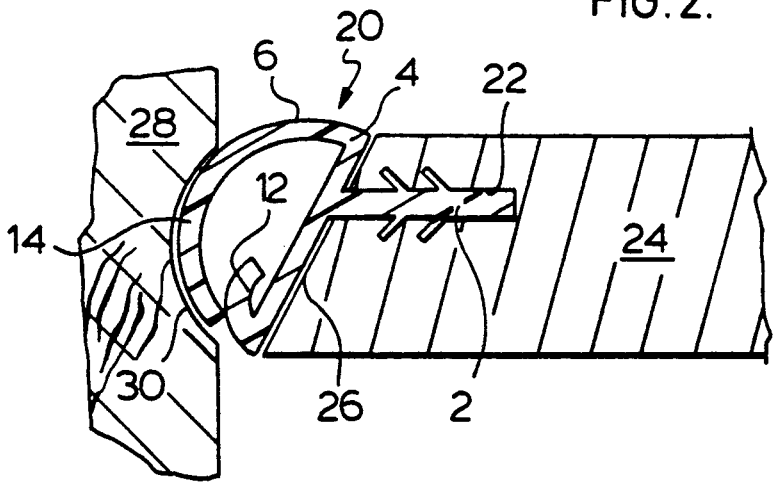
FIG. 2 is a cross-section of the preferred embodiment of the clip shown inserted in the end of a grille member.
Figure 3:
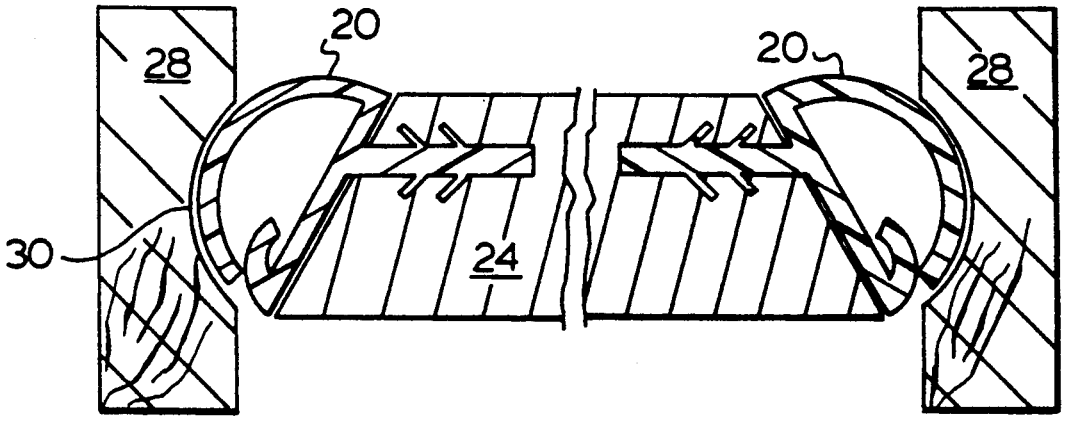
FIG. 3 is a cross-section view of a window grille according to a preferred embodiment in place in a window frame, or sash.
Figure 4:
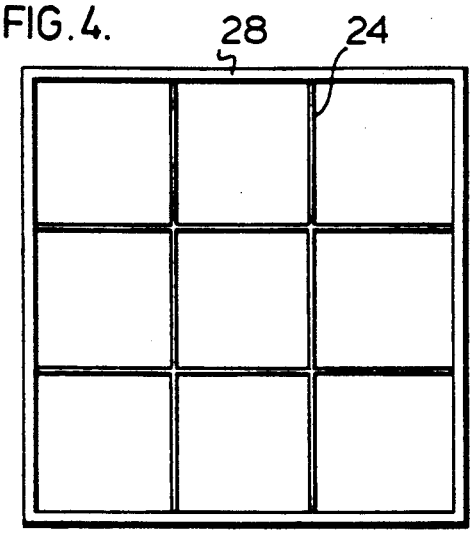
FIG. 4 is a perspective view of a preferred embodiment of window grille in place in a window frame, or sash.

As may be seen from FIG. 2, the clip 20 is inserted into a cavity 22 in the end of a grille member 24. The oblique angle between the base 4 and the stem 2 corresponds to the angle of the cut at the end of the grille member 26. Thus the base of the clip 4 is seated flush with the end of the grille member 26. The cavity 22 in the grille member 24 is parallel to the longitudinal axis of the grille member 24, thereby minimizing the structural weakening of the member 24 caused by the cavity 22.

When stem 2 is introduced into the cavity 22 which has been drilled in grille member 24, the teeth 8 and 10 engage the inner walls of the cavity 22 and secure the clip 20 to the grille member 24. Orientation of the teeth 8 and 10 towards the base 4 of the clip 20 ensures that the stem 2 may be inserted into the cavity 22 and that the stem 2 may not be easily removed. The stem 2 is intended to remain in the cavity 22 permanently and the sets of teeth 8 and 10 are sufficient to retain the clip 20 in the cavity 22 under normal conditions. No additional fastening device or material is required to affix the clip 20 to the grille member 24.

The grille clip 20 is designed to secure the grille member 24 in removable relation with a frame or sash 28. In order for the clip 20 to retain the end of the grille member 24 within groove 30 of frame or sash 28, the space between the end of the grille member 24 and the frame or sash 28 must be less than the height of the head of the clip 6. As the head 6 engages the groove 30, the arcuate members 12 and 14 flex towards the base 4.

When the grille member 24, with clip 20 in place, is brought into contact with frame or sash 29 in the region of groove 30, as for example, when the grille member is placed between two inward edges of a frame or sash 28, the head portion 6 of the clip 20 frictionally engages the groove 30 of frame or sash 28, serving to secure the grille member 24 to the frame or sash 28. The groove 30 in frame or sash 28 is dimensioned to receive the head 6 of the clip 20. The arcuate member 12 of the clip 20 serves to support and reinforce the arcuate member 14 when the head 6 is in the groove 30. The cooperative action between arcuate arms 12 and 14 permits arcuate arm 14 to have a thinner dimension than would otherwise be possible. The arcuate arm 14 flexes relatively easily until it contacts arcuate arm 12, thus providing two ranges of flexibility for the head 6 of the clip 20.

In order to remove the grille member 24 from frame or sash 28 the member 24 is merely pulled away from the frame or sash so that the clip 20 disengages from groove 30 in frame or sash 28. The arcuate arms 12 and 14 flex in order to permit the grille member 24 to be removed from the frame or sash 28. The force exerted to remove the member 24 must be greater than the frictional force supplied by the head 6 of clip 20 to the groove 34.

In one embodiment of the invention, the grille clip 20 is 17 mm in total length. The cross-section of the stem 2 is a square having a length and breath of 2 mm. The length of the base, measured between the edges to which the arcuate members are attached, is 12 mm.

In one embodiment of the invention, the clip 20 is made of one-piece moulded plastic. The plastic is nylon.

Figure 6:
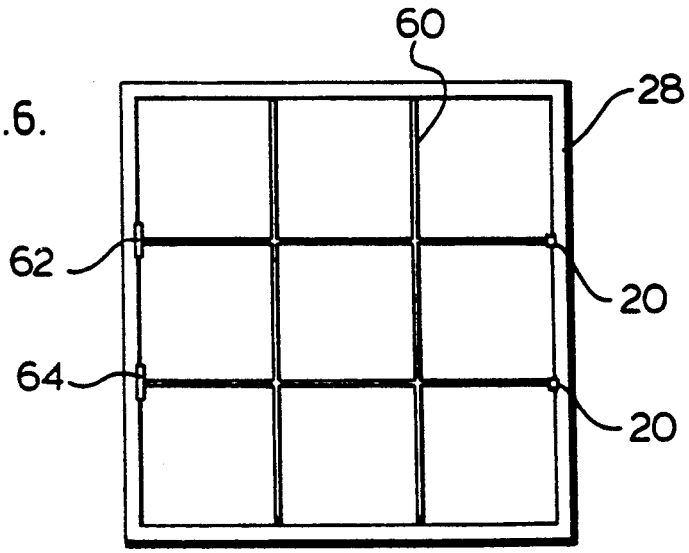
FIG. 6 is a preferred embodiment of a window grille having one set of ends of the grille secured to the frame by hinges and a second opposite set of ends detachably secured by grille clips.

A further embodiment of the invention is illustrated in FIG. 6. The clip 20 is here used in two places to retain a hinged grille 60 opposite a pair of hinges 62 and 64. The principle of operation of the clip 20 is as described above with reference to FIGS. 1 to 5. The grille 60 must be dimensioned in such a manner as to provide adequate frictional force to the clip 20 and the frame or sash 28 when the grille 60 is swung into the position in the frame or sash 28.

Other embodiments and modifications of the invention are possible.

For example, the clip may be used to secure a decorative grille in a door or in a frame or sash found in any other part of a building.

All such embodiments or modifications are believed to be within the scope of the clamps appended hereto.

I claim:

1. A clip for detachably securing a grille member to a frame or sash, said grille member having a cavity therein, comprising:

a. a rectangular cross-section stem adapted to be inserted in said cavity, said stem having a plurality of teeth extending therefrom for securing said stem within said cavity;

b. a flat, rectangular base connected to the stem at an oblique angle thereto;

c. two flexible, resilient arcuate members projecting from opposite edges of the base toward each other and away from the stem, the arcuate members being adapted to frictionally engage said frame or sash and thereby flexibly secure said grille member to the frame or sash.

2. The clip as defined in claim 1 wherein distal ends of the teeth are angled away from the distal end of the stem.

3. The clip as defined in claim 1 wherein said teeth are disposed intermediate the base of the clip and a distal end of the stem.

4. The clip as defined in claim 1 wherein the teeth are disposed on opposite sides of said rectangular cross-section stem.

5. The clip as defined in claim 1 wherein said stem is connected to the rectangular cross-section base closer to one edge thereof than tot he remaining edges thereof.

6. The clip as defined in claim 1 wherein said stem, based and arcuate members are fabricated from one-piece molded plastic material.

7. The clip as defined in claim 1 characterized by a total length of 17 mm, a square cross-section of said stem having a length and breadth of 2 mm, and wherein the length of the base, measured between the edges to which said arcuate members are attached, is 12 mm.

8. A window frame in combination with a grille member comprising at least one clip is for detachably securing the grille member to the window frame or sash, said grille member having a cavity therein, said clip comprising:

a. a rectangular cross-section stem adapted to be inserted in said cavity, said stem having a plurality of teeth extending therefrom for securing said stem within said cavity;

b. a flat, rectangular base connected to the stem at an oblique angle thereto;

c. two flexible, resilient arcuate members projecting from opposite edges of the base toward each other and away from the stem, the arcuate members being adapted to frictionally engage said window frame or sash and thereby flexibly secure said grille member to the window frame or sash.

* * * * *

UNITED STATES PATENT AND TRADEMARK OFFICE

CERTIFICATE OF CORRECTION

PATENT NO. : 5,174,091

DATED : December 29, 1992

INVENTOR(S) : Gary Stokx

It is certified that error appears in the above-identified patent and that said Letters Patent is hereby corrected as shown below:

Col. 1, line 54, "bass" should be --base--.

Col. 2, line 7, after "of" insert --the--.

Col. 2, line 66, "member" should be --members--.

Col. 3, line 46, "tot he" should be --to the--.

Col. 3, line 48, "on" should be --one--.

Col. 4, line 13, "29" should be --28--.

Col. 4, line 39, "breath" should be --breadth--.

Col. 4, line 60, "clamps" should be --claims--.

Col. 5, line 20, "tot he" should be --to the--.

Signed and Sealed this

Fourth Day of January, 1994

*Attest:*

Bruce Lehman

BRUCE LEHMAN

*Attesting Officer*

*Commissioner of Patents and Trademarks*